US006715529B2

(12) United States Patent
Farooq

(10) Patent No.: US 6,715,529 B2
(45) Date of Patent: Apr. 6, 2004

(54) ROLLING SHUTTER ASSEMBLY

(76) Inventor: Humayoun Farooq, 1235 SW. 87 Ave., Miami, FL (US) 33174

( * ) Notice: Subject to any disclaimer, the term of this patent is extended or adjusted under 35 U.S.C. 154(b) by 28 days.

(21) Appl. No.: 10/237,304

(22) Filed: Sep. 5, 2002

(65) Prior Publication Data

US 2003/0041978 A1 Mar. 6, 2003

Related U.S. Application Data

(60) Provisional application No. 60/317,728, filed on Sep. 6, 2001.

(51) Int. Cl.[7] ..... E06B 9/08

(52) U.S. Cl. ..... 160/133; 160/119; 160/235; 160/273.1

(58) Field of Search ..... 160/133, 118, 160/119, 273.1, 235, 236, 32, 35, 36

(56) References Cited

U.S. PATENT DOCUMENTS 2,275,730 A * 3/1942 Casse ..... 160/119 X
4,428,218 A * 1/1984 LaRocca ..... 160/235 X
4,785,494 A * 11/1988 Adamski ..... 160/133 X
5,343,924 A * 9/1994 Hoffman ..... 160/235
5,839,493 A * 11/1998 Quasius ..... 160/133

* cited by examiner

*Primary Examiner*—David Purol
(74) *Attorney, Agent, or Firm*—Robert M. Downey, P.A.

(57) ABSTRACT

A rolling shutter assembly includes a plurality of interconnecting metal slats each having a front face, a rear face, and opposite end zones. The end zones travel within respective tracks which mount to a wall structure on opposite sides of a window or door of a building structure. Parallel, transversely extending slots cut into the front and rear faces of the slats, at the opposite end zones thereof, are keyed to inwardly directed fins within the respective tracks to allow sliding movement of the end zones along the tracks while preventing jamming or disengagement of the slats from the tracks. Various mounting brackets are provided for mounting the tracks to the building wall structure to accommodate different installation requirements.

17 Claims, 7 Drawing Sheets

ROLLING SHUTTER ASSEMBLY

This application claims the benefit of provisional 60/317,728 filed on Sep. 6, 2001.

BACKGROUND OF THE INVENTION

1. Field of the Invention

The present invention relates to rolling shutters for covering windows, doors and other portal openings of a building structure and, more particularly, to an improved rolling shutter assembly having slats which are structured and disposed for sliding travel within spaced, parallel tracks in a manner which withstands high wind velocities and forced entries without disengagement of the slats from the track.

2. Discussion of the Related Art

Protective shutters for covering windows, doors and other portal openings of a building structure (i.e. homes and buildings) are well known in the art. In most cases, shutters are used for the primary purpose of protecting windows and doors from high wind velocities and flying debris during tropical storms and hurricanes. Protective shutters are also useful to provide added security and privacy, as well as to block unwanted sunlight from entering a home or building which thereby may reduce the cost for cooling the interior space.

Of particular relevance to the present invention are rolling shutter assemblies which typically include elongate plastic (PVC) or aluminum slats that are hinged together along their top and bottom edges. The slats are typically arranged horizontally between a pair of vertical side tracks anchored to a building wall structure, on opposite sides of a window or door. The tracks are structured and disposed to allow for sliding movement of the slats along the tracks between a stored, rolled-up position and a fully deployed, unrolled position wherein the slats are disposed in protective, covering relation to the window or door.

One major problem which is common to many existing rolling shutter designs is the lack of structural integrity between the slats and the tracks. In many instances, the slats are retained within the tracks with the use of screws which attach to the opposite ends of the slats and extend outwardly therefrom. Typically, with this type of assembly, the screws are fitted with screw bosses which are received between the inwardly directing fins within the track. An enlarged flange on the head of the screw captivates the end of the screw behind the fins. This method of retaining the slats within the tracks has been found to be problematic in the past. Specifically, it has been found that the slats can become dislodged from the tracks during operation when moving the slats along the tracks. Also, it has been found that the screw heads are sometimes sheared off when a sufficient force of impact is applied to the slats. The use of plastic slats (e.g. PVC) has also been found to be extremely problematic due to the tendency of plastic material to flex excessively when subjected to impact forces. In fact, most rolling shutter assemblies which use plastic slats do not comply with current building code requirements due to excessive flexing which causes the slats to be dislodged from the track when subjected to an impact test.

In order to overcome the above-noted problems, various improvements to rolling shutter assemblies have been proposed. In particular, U.S. Pat. No. 5,253,694 to Bernardo discloses an improvement in rolling shutters that includes a slat end retainer attached to the ends of individual shutter slats. The slat retainers are contoured and configured for securing a slat end to the side tracks of the rolling shutter assembly. Specifically, the slat end retainers each include a pair of contoured inner and outer flanges formed from a unitary body of molded rigid plastic (PVC or nylon). A slot is formed between the inner and outer flanges and is adapted to receive the fins of the side tracks therein, so that the slats are held within the tracks in a manner which permits sliding movement without disengagement or jamming of the slat ends. While the invention of Bernardo is an improvement in the rolling shutter art, the attachment of plastic slat end retainers to the slats can be problematic. Specifically, the structural integrity between the slats and the tracks is largely dependent on the rivets which secure the slat end retainer to the end of the slats. These rivets can be sheared when the slats are subjected to forces of impact, thereby causing separation and dislodgment of the slat end retainers from the ends of the slats and, accordingly, separation of the slats from the tracks. Also, the stem portion of the slat end retainers of the Bernardo assembly, which is made of a plastic material, can be sheared or cracked when subjected to forces of impact.

Accordingly, there remains an urgent need in the art of rolling shutters for an improved means for securing the ends of the slats within the tracks so that the slats do not become jammed within the track or disengaged from the track when subjected to high wind velocities and forces of impact. More particularly, there is an urgent need for an improvement in the structural integrity between the slats and the tracks in a rolling shutter assembly.

SUMMARY OF THE INVENTION

The present invention is directed to an improved rolling shutter assembly and includes a plurality of interconnecting metal slats moveably keyed within oppositely disposed side tracks. Each slat includes a front face, a rear face, and opposite end zones which travel within the respective tracks. Transverse slots are cut into the front and rear faces of the slats, at the opposite end zones and extend between the top and bottom edges of the slats. The slots are keyed to inwardly directed fins in the respective tracks to allow sliding movement of the end zones along the tracks while preventing jamming or disengagement of the slats from the tracks.

OBJECTS AND ADVANTAGES OF THE INVENTION

With the foregoing in mind, it is a primary object of the present invention to provide an improved rolling shutter assembly which provides for increased structural integrity between the slats and the tracks.

It is a further object of the present invention to provide an improved rolling shutter assembly which includes a plurality of integrally formed one-piece metal slats, including means thereon for retaining the slats within the tracks of the rolling shutter assembly.

It is still a further object of the present invention to provide an improved rolling shutter assembly, including a plurality of integrally formed, one-piece metal slats, and wherein each of the slats includes means integrally formed on the opposite ends for retaining the opposite ends of the slats within the tracks of the rolling shutter assembly.

It is still a further object of the present invention to provide an improved rolling shutter assembly which has fewer component parts than conventional rolling shutter assemblies.

It is yet a further object of the present invention to provide an improved rolling shutter assembly which is less costly to manufacture than conventional rolling shutter assemblies.

It is yet a further object of the present invention to provide an improved rolling shutter assembly which includes a plurality of different mounting brackets for mounting the tracks of the assembly to wall surfaces of a building structure to accommodate for a variety of installation requirements.

These and other objects and advantages of the invention are more readily apparent with reference to the following detailed description and the accompanying drawings.

BRIEF DESCRIPTION OF THE DRAWINGS

For a fuller understanding of the present invention, reference should be made to the following detailed description taken in conjunction with the accompanying drawings in which.

Like reference numerals refer to like parts throughout the several views of the drawings.

DETAILED DESCRIPTION OF THE PREFERRED EMBODIMENTS

Figure 1:
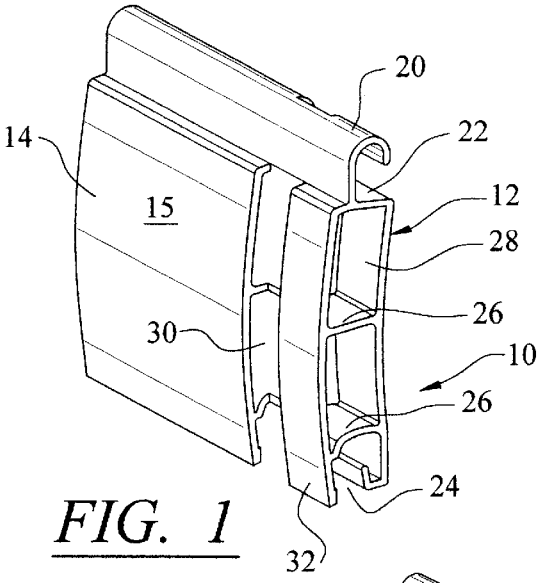
FIG. 1 is a partial front perspective view of a slat of the rolling shutter assembly of the present invention, showing an end portion thereof.
Figure 2:
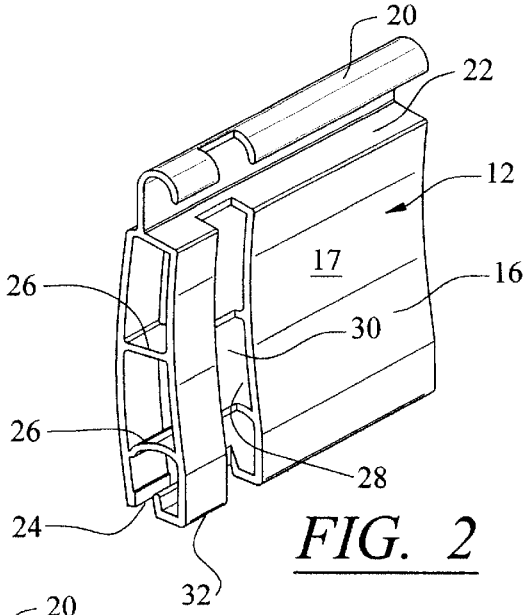
FIG. 2 is a rear perspective view of the end portion of the slat of FIG. 1.
Figure 3:
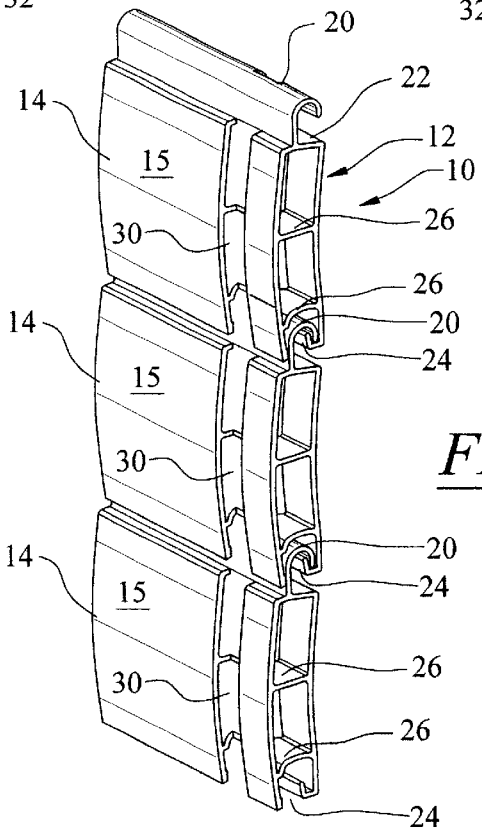
FIG. 3 is a front perspective view showing a plurality of slats of the rolling shutter assembly of the present invention interconnected to one another along top and bottom edges thereof.

Referring to the several views of the drawings, and initially FIGS. 1–3, the rolling shutter assembly of the present invention is generally indicated as 10 and includes a plurality of slats 12 formed of aluminum or other metal material and having an outer curved wall 14 with a front face 15 and an inner curved wall 16 integrally joined with the outer wall and including a rear face 17. An integral hook portion 20 extends along the top end 22 which joins the outer and inner walls. A female hook connector opening 24 is formed along the bottom of the slat 12, between the outer and inner walls 14, 16. Longitudinal webs 26 are integrally formed with the outer and inner walls and extend through a hollow interior 28 defined between the spaced outer and inner walls. The hook portion 20 and female hook connector 24 are specifically structured and configured to allow the slats 12 to be connected along their respective top and bottom edges, as shown in FIG. 3, for hinged movement of the slats relative to one another during operation of the shutter assembly. Transverse slots 30 are cut through the outer and inner walls 14, 16 of the slats 12, at opposite end zones 32, 34, as seen in FIGS. 1–3. The slots 30 extend partially through the hook portion 20 and the female hook connector 24, as shown, and are specifically structured and disposed for retaining the slats within opposite tracks 40 of the assembly 10 and for permitting sliding movement of the slats 12 along the length of the tracks 40, as described more fully hereinafter.

Similar to conventional rolling shutter assemblies, the present invention includes longitudinal side tracks 40 which mount to an exterior wall surface 100 of a building structure (e.g. a house or building). Each side track is formed as an extruded aluminum rectangular tube having an open end 42, opposite sides 44, 45, a base 46 and first and second internal chambers 50, 52. The first chamber 50 is completely enclosed within four walls, including the base 46, the opposite sides 44, 45 and an interior wall 48 and is essentially used for mounting the track 40 to a wall surface 100 adjacent the window, door or other portal opening of the building structure. This closed rectangular chamber 50 is conventional and does not form a part of the invention. The second chamber 52 is defined between the opposite side walls 44, 45 of the track and the interior wall 48 separating the first and second chambers 50, 52. The second chamber 52 communicates with the open end 42 to define a throat 54 for receipt of the end portions 32, 34 of the slats 12 therein. Fins 56 extend inwardly, at an angle, from the inner side wall surfaces 58 of the second chamber, midway between the open end 42 and the interior wall 48. The fins 56 are specifically structured and configured for keyed receipt within the slots 30 formed on the inner and outer walls of the slats 12 at the opposite end zones 32, 34. The keyed arrangement of the fins 56 and slots 30 serves to retain the end zones 32, 34 of the slats within the tracks 40. More particularly, the integral nature of the slots 30 as part of the one-piece metal slats 12 serves to provide greater structural integrity between the slats 12 and the tracks 40, as compared to previous known rolling shutter assembly designs. This keyed arrangement between the fins 56 within the track and the integrally formed slots 30 on the opposite end zones 32, 34 of the metal slats prevents the end zones of the slats from being disengaged or dislodged from the throat 54 of the tracks 40 when the slats 12 are subjected to severe external forces, such as those which result from high wind velocities, flying projectiles and attempted forced entries of vandalism. Furthermore, the keyed arrangement of the fins 56 and slots 30, which avoids the use of separate retainer parts attached to the slats, is far less likely to experience jamming of the slat ends within the track. It should be noted that the slots 30 formed in the opposite end zones 32, 34 may be fitted with nylon or polypropylene inserts to prevent metal to metal contact between the slat ends and the fins, thereby reducing noise and promoting smoother travel of the slat ends within the tracks.

Figure 4:
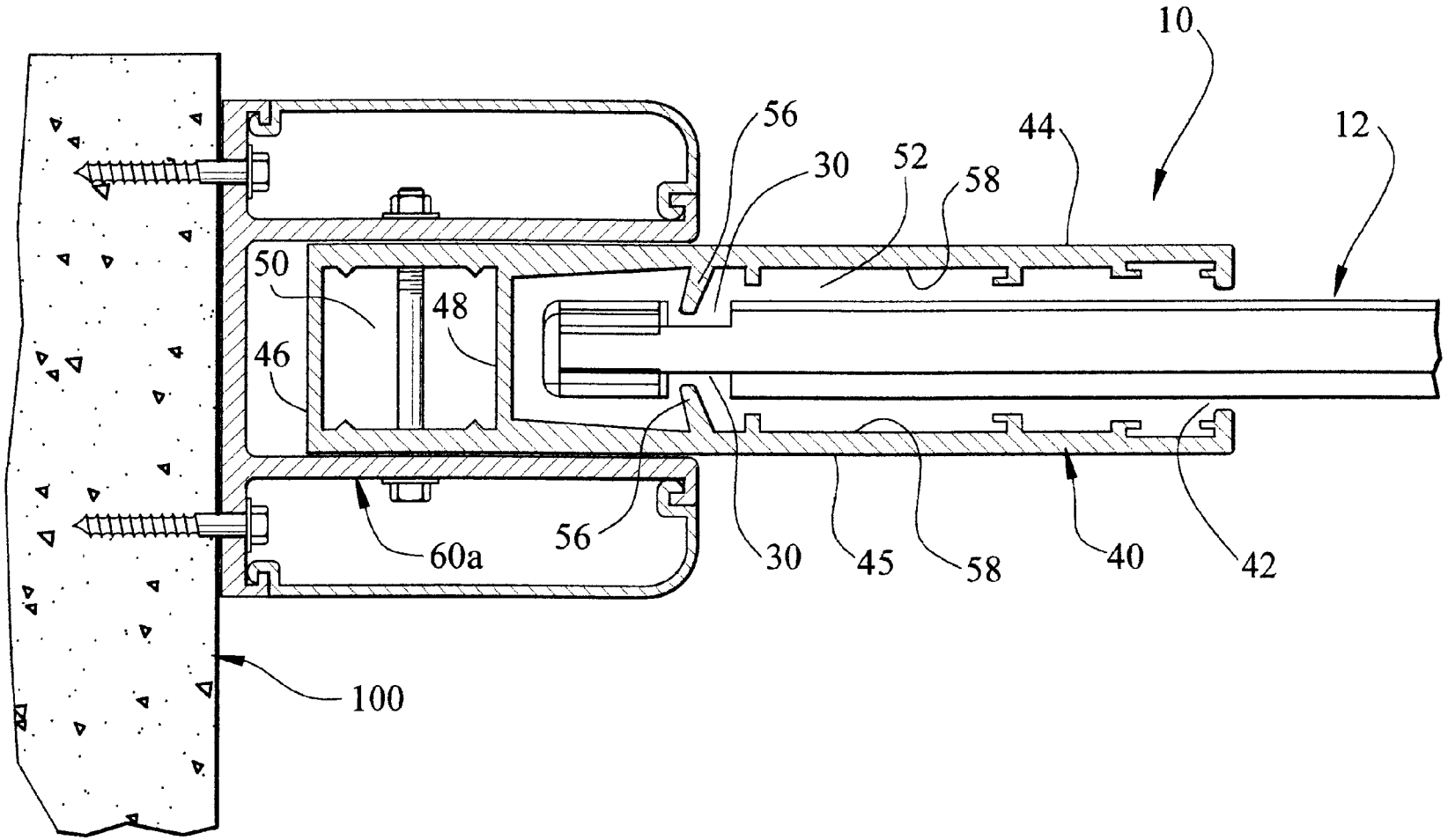
FIG. 4 is a top plan view, in partial cross-section, showing the end portion of a slat operatively received within the throat of a track of the rolling shutter assembly, and a mounting bracket for mounting the track to a wall surface.
Figure 5:
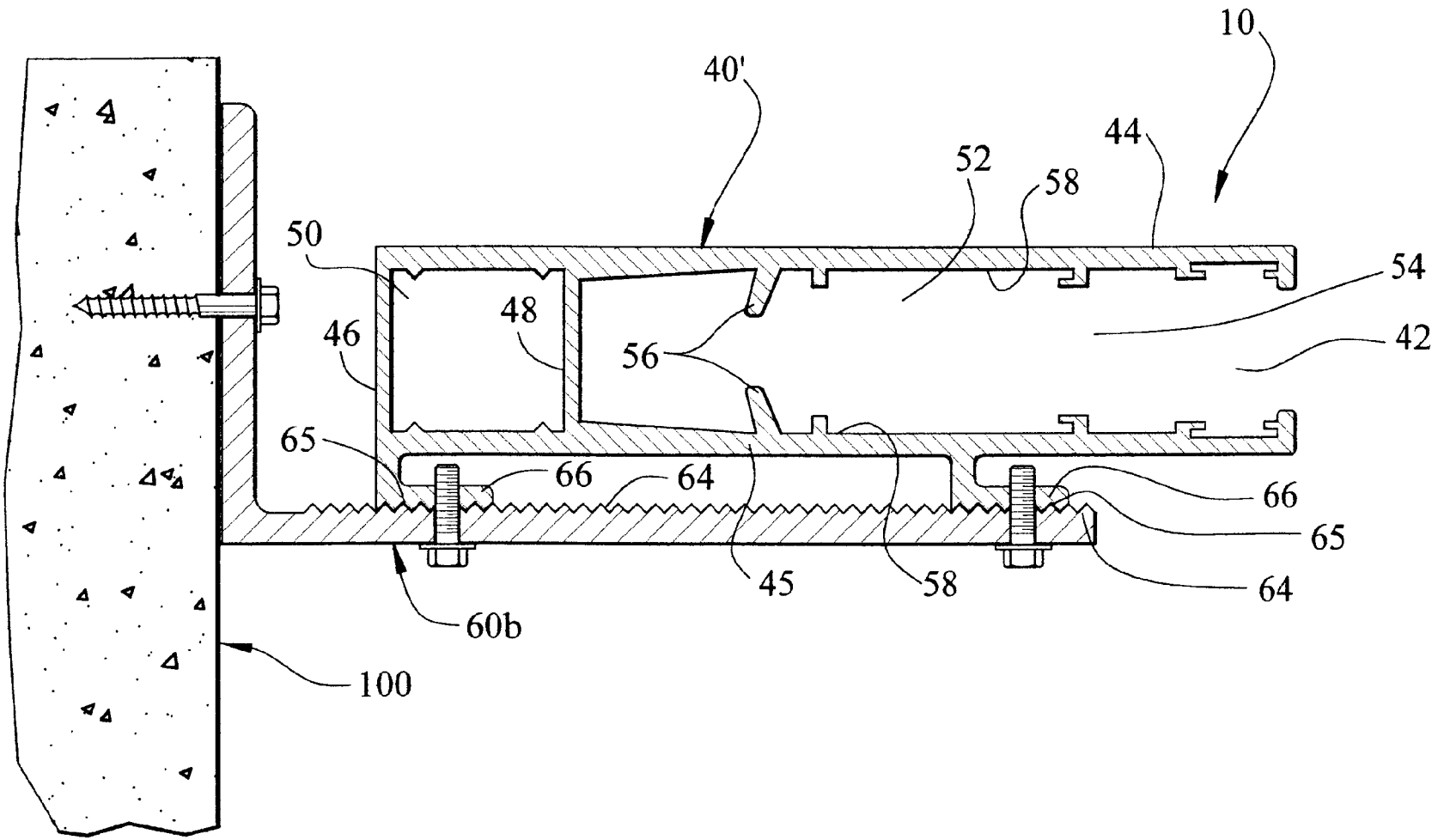
FIG. 5 is a top plan view, in partial section, showing an alternative track and mounting bracket of the rolling shutter assembly.
Figure 6:
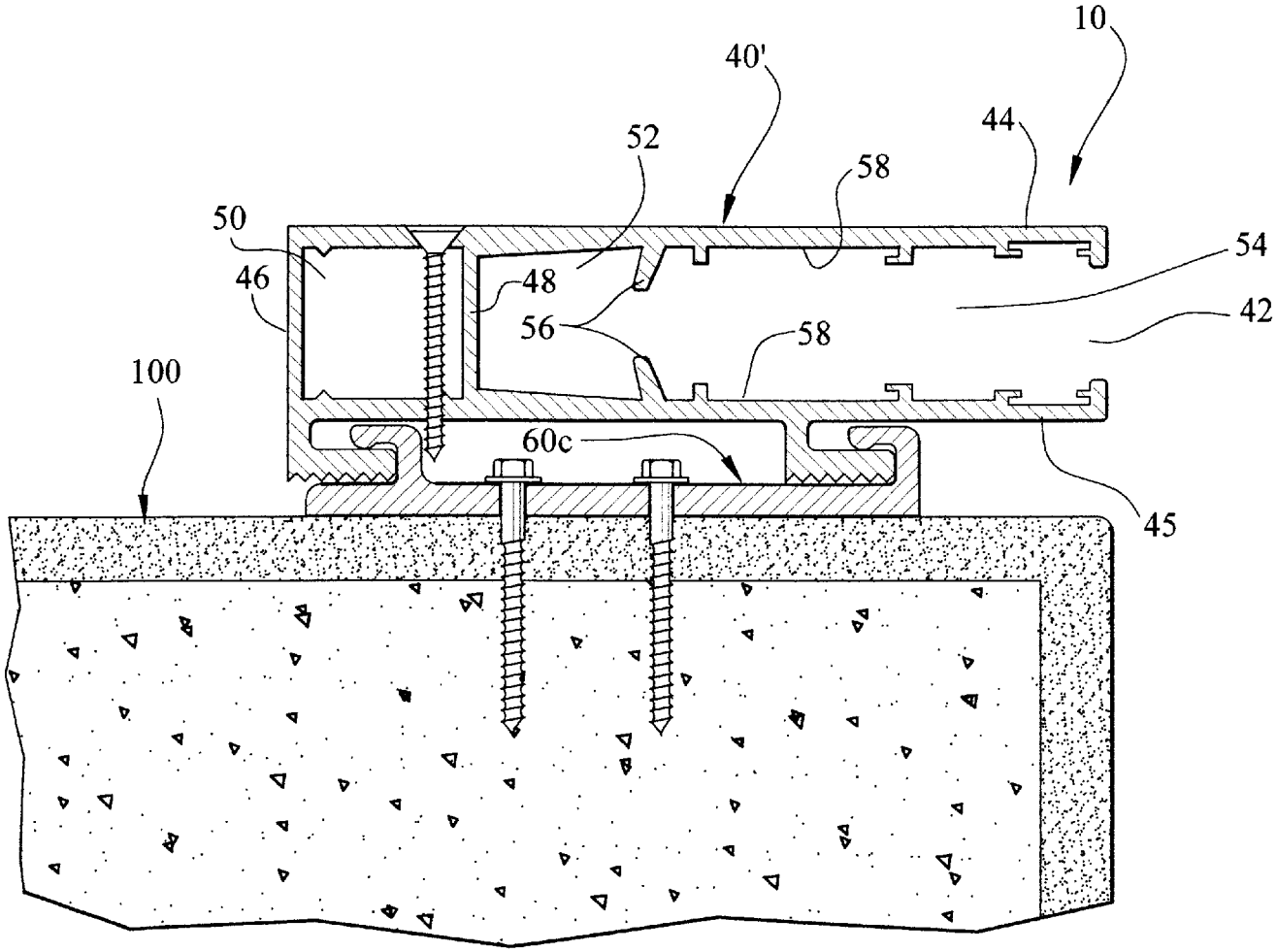
FIG. 6 is a top plan view, in partial section, showing another embodiment of a mounting bracket for mounting the track of FIG. 5 to a wall surface.
Figure 7:
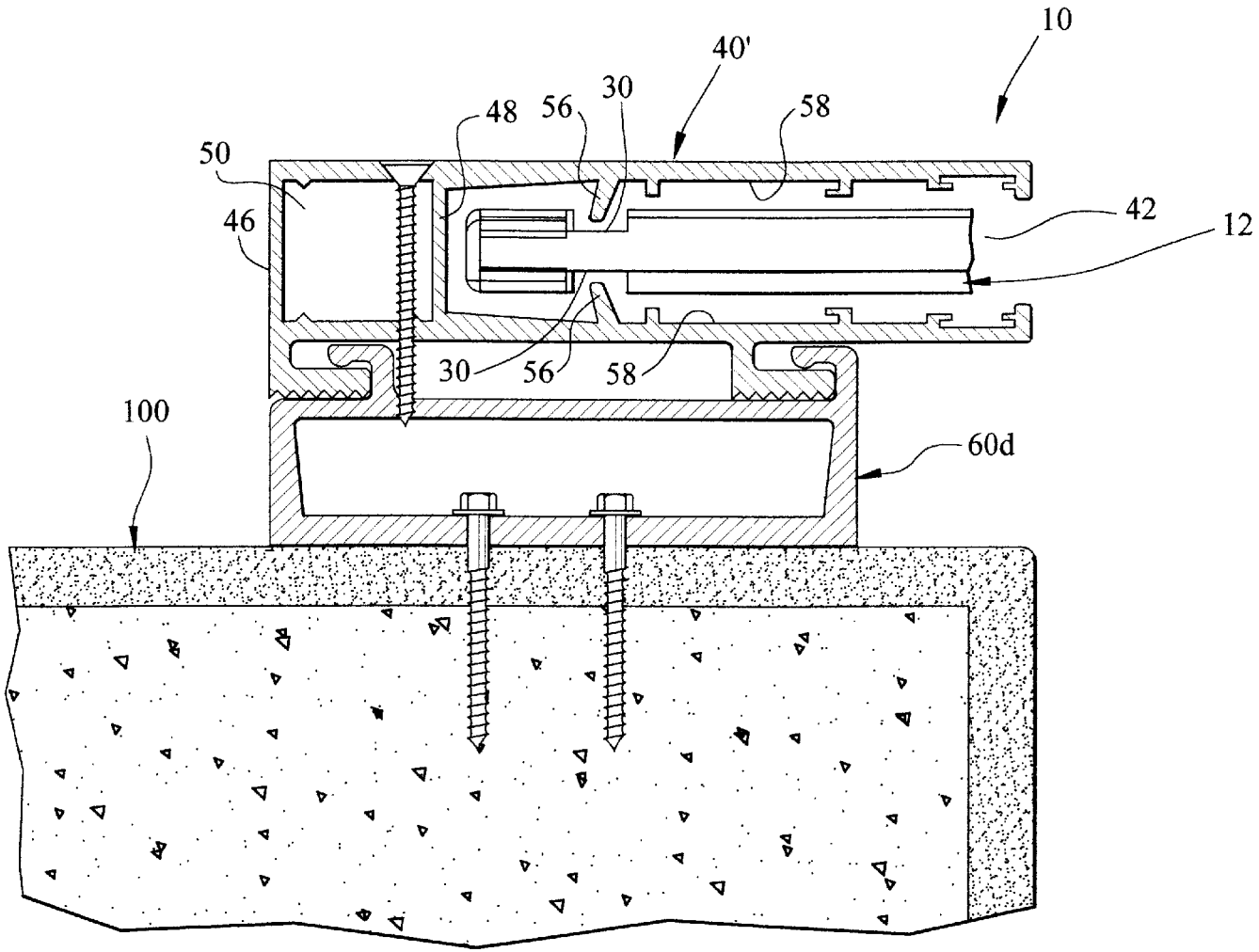
FIG. 7 is a top plan view, in partial section, showing yet a further embodiment of a mounting bracket for mounting the track of FIG. 5 to a wall surface in a build-out installation in order to increase the distance between the slats of the rolling shutter assembly and a protected structure (e.g. a window or door)

Referring to FIGS. 4–7, various means for mounting the tracks 40 to wall surfaces 100 are shown to accommodate a variety of installation methods. Specifically, FIG. 4 shows a bracket 60*a* for mounting the tracks 40 to an inside facing surface within a portal or recessed area surrounding a window or door. FIG. 5 shows an alternative inside mount assembly comprising an L-shaped angle bracket 60*b* with a toothed surface 64 for congruent, mating engagement with a toothed surface 65 of leg members 66 extending from the track 40'. FIG. 6 shows another embodiment of a mounting bracket 60*c* for mounting the track 40' of FIG. 5 to an outside wall surface. FIG. 7 shows yet another embodiment of a mounting bracket 60*d* for mounting the track 40' of FIG. 5 to an outside wall surface of the building structure. The mounting bracket 60*d* of FIG. 7 is specifically structured to mount the tracks 40' at a predetermined distance from the exterior wall surface 100 of the building structure, thereby maintaining a desired distance of separation between the slats 12 and the protected structure (i.e. window or door) to satisfy specific building code requirements.

Figure 8:
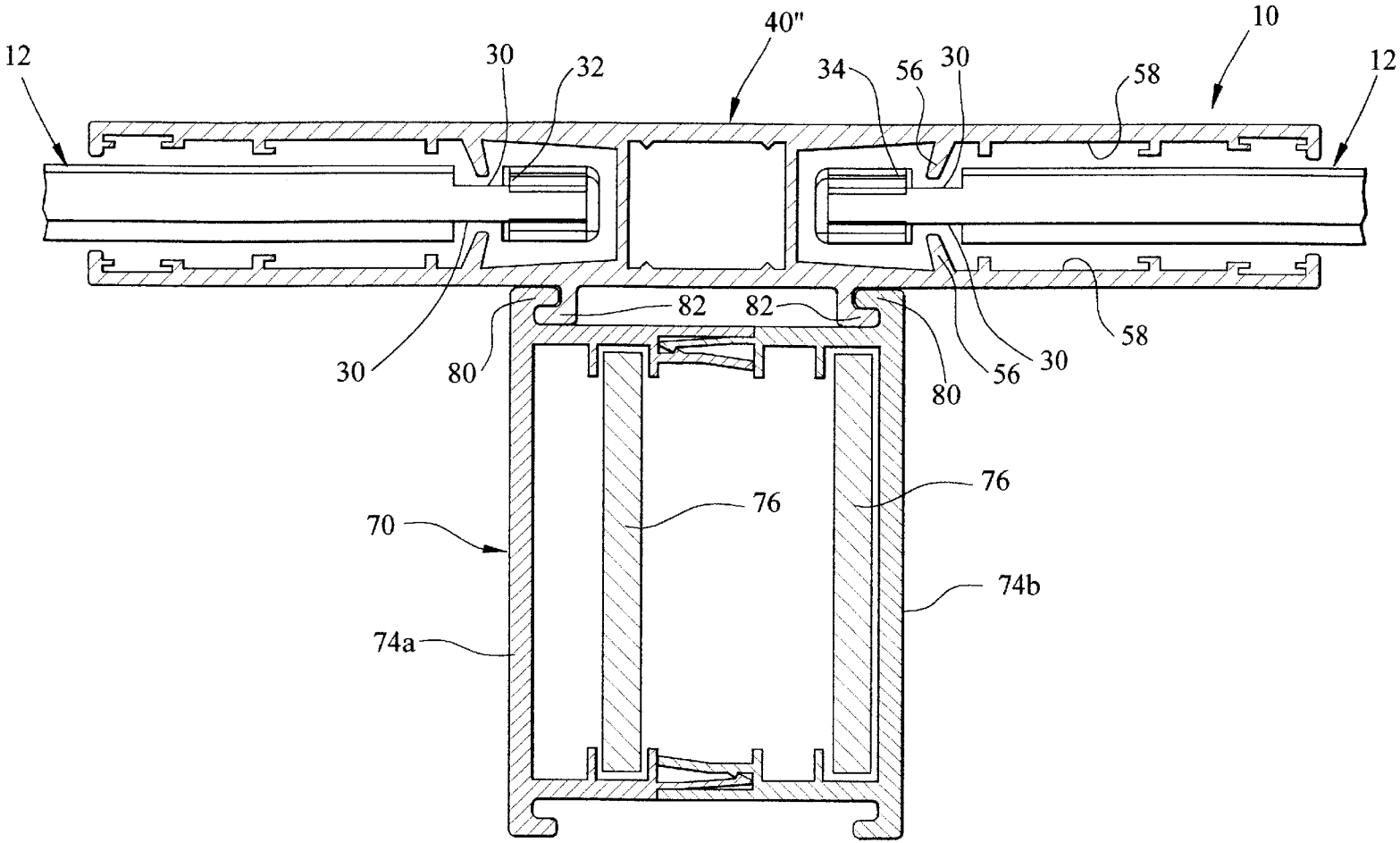
FIG. 8 is a top plan view, in partial section, showing a center mullion mounting assembly for mounting a dual track to a center mullion in accordance with yet another embodiment of the present invention.
Figure 9:
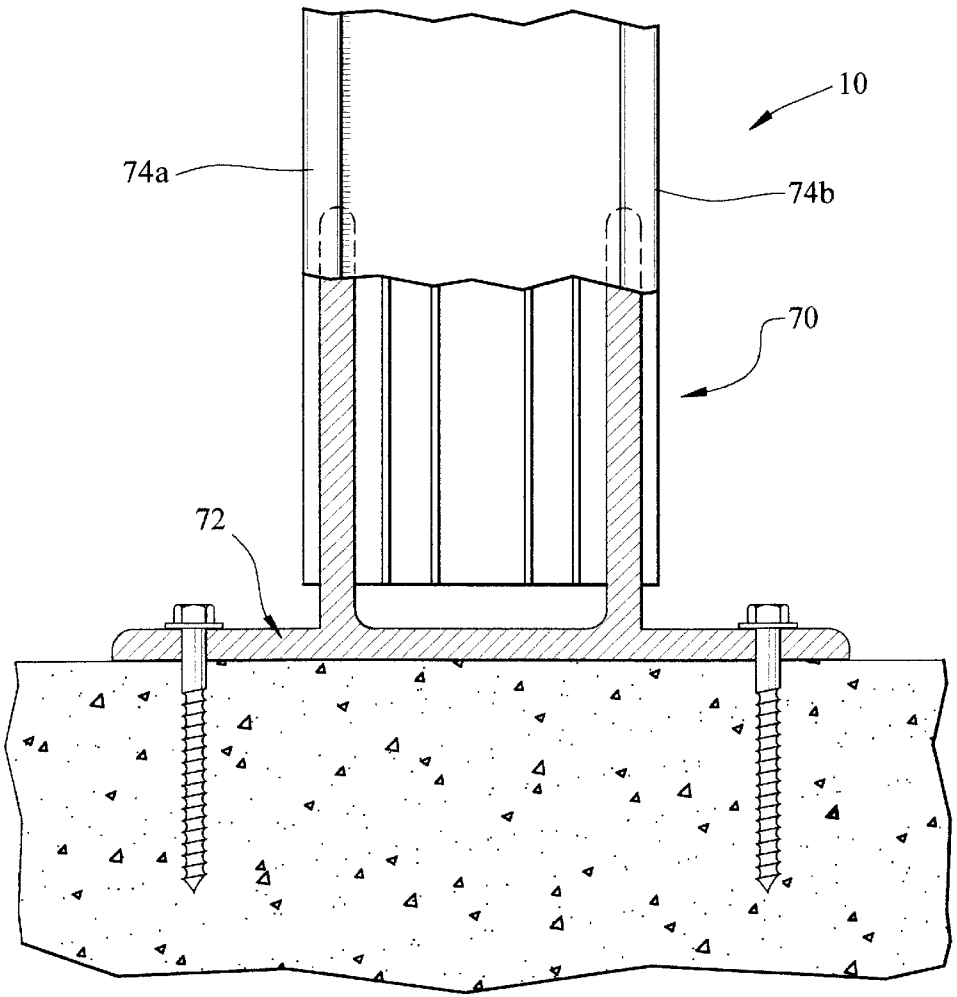
FIG. 9 is an isolated elevational view, in partial phantom, showing a mounting bracket for the center mullion mounting assembly of FIG. 8.

FIGS. 8 and 9 illustrate a center mullion mounting assembly 70 which is used for mounting two or more rolling shutter assemblies 10 in a side-by-side relation for installations requiring protection of extra wide doors or windows (e.g. sliding glass doors). The center mullion mounting assembly 70 includes a pair of base mounting brackets 72 which mount to both the floor surface and overhead ceiling surface at opposite ends of the mullion 70. The mullion 70 is formed by a pair of interlocking post members 74*a* and 74*b* which are fitted with reinforced steel inserts 76, as shown in FIG. 8. The reinforced steel inserts 76 extend the length of the mullion post members 74*a*, 74*b* and provide added strength and rigidity to thereby prevent flexing, bending or collapse of the center mullion mounting assembly 70 when subjected to stress, such as that which occurs in a hurricane or attempted vandalism. As shown in FIG. 8, the post members 74*a*, 74*b* of the center mullion mounting assembly 70 are provided with inwardly directed fingers 80 for interlocking engagement with corresponding fingers 82 extending from a double-sided track 40", thereby facilitating mounting of the track 40" to the center mullion assembly 70.

While the present invention has been shown and described in accordance with practical and preferred embodiments thereof, it is recognized that the spirit and scope of the present invention is not limited to the instant disclosure which is provided for the purpose of facilitating an understanding of the invention.

What is claimed is:

1. A rolling shutter assembly moveable within oppositely disposed end guide tracks, said shutter assembly comprising:

a plurality of slats, each of said plurality of slats including a front face, a rear face, a top edge, a bottom edge and opposite end zones;

said opposite end zones of each of said slats including parallel, transversely extending slots integrally formed in said front and rear faces, respectively, and said transversely extending slots at each of said opposite end zones being structured and configured for sliding, captured receipt within a respective one of the oppositely disposed end guide tracks; and link means formed on said top and bottom edges of said slats for linking said plurality of slats together and permitting rolling movement of said slats, in unison, along said guide tracks between an open, stored position and a closed, deployed position.

2. The assembly as recited in claim 1 wherein each of said plurality of slats are integrally formed as a one-piece structure.

3. The assembly as recited in claim 2 wherein each of said plurality of slats are formed of metal.

4. The assembly as recited in claim 3 wherein each of said plurality of slats are formed of aluminum.

5. The assembly as recited in claim 1 wherein said link means formed on said top and bottom edges of each of said plurality of slats comprises:

a male hook portion integrally formed along said top edge;

a female hook connector integrally formed along said bottom edge; and wherein said male hook portion is structured and disposed for interconnected, linked engagement with said female hook connector of an adjacently positioned slat.

6. The assembly as recited in claim 1 further comprising:

bracket means for mounting the guide tracks in a manner which supports the rolling shutter assembly in protective, operative position relative to a building structure.

7. The assembly as recited in claim 6 wherein said bracket means is structured and disposed for mounting the guide tracks to the building structure to support said plurality of slats at a predetermined spaced distance from the building structure when said plurality of slats are moved to the closed, deployed position.

8. The assembly as recited in claim 6 wherein said bracket means includes a center mullion mounting assembly comprising:

a pair of base mounting brackets, including a first mounting bracket structured and disposed for mounting to a floor surface and a second base mounting bracket structured and disposed for mounting to an overhead surface above said floor surface; and a mullion attachable to said pair of base mounting brackets so as to extend therebetween in fixed, supported and vertically extending relation between said floor surface and said overhead surface, and said mullion being structured and disposed to support at least one of the end guide tracks.

9. The assembly as recited in claim 8 wherein said mullion includes reinforcing means to provide added strength and rigidity to said mullion in order to resist flexing, bending or collapse of the mullion.

10. A rolling shutter assembly comprising:

a plurality of slats, each of said plurality of slats including a front face, a rear face, a top edge, a bottom edge and opposite end zones;

said opposite end zones of each of said slats including parallel, transversely extending slots integrally formed in said front and rear faces, respectively;

a pair of oppositely disposed, parallel end guide tracks each having an open end communicating with a track throat for receipt of a respective one of said opposite end zones of each of said slats therein;

each of said pair of end guide tracks including a pair of rigid fins positioned and disposed on opposite sides of said track throat, said fins being structured and disposed for keyed receipt within the slots formed in the front and rear faces of said plurality of slats to captivate the opposite end zones within the respective end guide tracks; and link means formed on said top and bottom edges of said slats for linking said plurality of slats together and permitting rolling movement of said slats, in unison, along said guide tracks between an open, stored position and a closed, deployed position.

11. The assembly as recited in claim 10 wherein each of said plurality of slats is integrally formed as a one-piece structure.

12. The assembly as recited in claim 11 wherein each of said plurality of slats is formed of metal.

13. The assembly as recited in claim 12 wherein each of said plurality of slats is formed of aluminum.

14. The assembly as recited in claim 10 wherein said link means formed on said top and bottom edges of said plurality of slats comprises:

a male hook portion integrally formed along said top edge;

a female hook connector integrally formed along said bottom edge; and wherein said male hook portion is structured and disposed for interconnected, linked engagement with said female hook connector of an adjacently positioned one of said plurality of slats.

15. The assembly as recited in claim 10 further comprising:

bracket means for mounting the guide tracks in a manner which supports the rolling shutter assembly in protective, operative position relative to a building structure.

16. The assembly as recited in claim 15 wherein said bracket means is structured and disposed for mounting the guide tracks to the building structure to support said plurality of slats at a predetermined spaced distance from the building structure when said plurality of slats are moved to the closed, deployed position.

17. A rolling shutter assembly moveable within oppositely disposed end guide tracks, said shutter assembly comprising:

a plurality of slats, each of said plurality of slats including a front face, a rear face, a top edge, a bottom edge and opposite end zones;

said opposite end zones of each of said slats including parallel, transversely extending slots integrally formed in said front and rear faces, respectively, and said transversely extending slots at each of said opposite end zones being structured and configured for sliding, captured receipt within a respective one of the oppositely disposed end guide tracks; and means for linking said slats together.

* * * * *